United States Patent [19]

Fucci

[11] Patent Number: 5,050,866

[45] Date of Patent: Sep. 24, 1991

[54] PUNCHING BAG SUPPORT DEVICE

[76] Inventor: John P. Fucci, 111 Riverside St., Watertown, Mass. 02172

[21] Appl. No.: 395,760

[22] Filed: Aug. 18, 1989

[51] Int. Cl.[5] ..... A63B 63/08; A63B 69/00

[52] U.S. Cl. ..... 272/78; 278/1.5 R

[58] Field of Search ..... 272/78, 76, 77, 109, 272/61, 62, 63; 273/1.5 R, 347, 29 BB, 29 BC; 248/161

[56] References Cited

U.S. PATENT DOCUMENTS

| | | | |
|---|---|---|---|
| 1,890,696 | 12/1932 | Rosenhahn . | |
| 2,625,356 | 1/1953 | Kennedy et al. | 248/121 |
| 2,697,603 | 12/1954 | Haines | 273/1.5 |
| 2,913,245 | 11/1959 | Landis | 272/78 |
| 2,986,395 | 5/1961 | Sheftel | 272/78 |
| 3,510,131 | 5/1970 | Gardner | 272/78 |
| 3,598,406 | 8/1971 | Robinson | 272/61 |
| 4,522,394 | 6/1985 | Broussard | 272/78 |

*Primary Examiner*—Stephen R. Crow

*Attorney, Agent, or Firm*—Wolf, Greenfield & Sacks

[57] ABSTRACT

A free-standing punching bag support device that includes a base and at least two telescoping sections, one of which is designed to be raised and lowered in relation to the other section in order to change the height of a punching bag which is attached to an upper support frame that is in turn attached to one of the telescoping sections. The apparatus additionally includes a rack and pinion gear system for adjusting the height of the punching bag and a spring loaded locking gear designed to hold the punching bag at the desired adjusted height. A pressure cylinder is disposed between the base and the movable telescoping support member and acts to quickly raise the height of the punching bag, but deliberately slows the downward movement for both enhanced safety and controlability. In other embodiments, the pinion gear may be turned either by a hand crank or an electric motor. The pressure cylinder may include a sealed gas cylinder, a gas cylinder that is pressurized by an air pump, or a sealed liquid-filled pressure cylinder.

20 Claims, 6 Drawing Sheets

80
110
130
70
200
72
40
40
20
240
250
250
10

PUNCHING BAG SUPPORT DEVICE

BACKGROUND OF THE INVENTION

1. Field of the Invention

The present invention relates generally to the field of athletic equipment. More particularly, the present invention relates to a free standing punching bag support stand that can be quickly and safely adjusted to accommodate users of different heights.

2. Discussion of the Prior Art

Athletic equipment that is going to be used by people of differing stature needs to be adjustable so that the particular piece of athletic equipment will allow the user to gain the greatest physical benefit from the use of the particular piece of equipment. In addition, the athletic equipment needs to be adjustable so that users of differing physical stature can safely use the piece of equipment without undue strain during exercise. In the case of punching bags, and in particular what is known as speed bags, the stand holding the speed bag must be adjusted so that the punching bag will be at the proper height in relation to the user.

A variety of adjustable pieces of athletic equipment have been constructed in the prior art. A number of these devices have used, for example, telescoping support sections with locking pins that run perpendicularly through the overlapping telescoping portions in order to hold the piece of equipment at the required height. In general, these devices have a series of holes running perpendicularly through and longitudinally aligned along one supporting section designed to be aligned with a similar arrangement of holes in another supporting portion. After the holes in the respective sections are aligned, a locking pin is inserted to hold the equipment at the desired height. These devices require the user to remove the locking pin, either raise or lower the telescoping section to the appropriate height, and then reinsert the locking pin. If the piece of equipment is heavy, supporting one telescoping section with one hand while removing the locking pin with the other hand may require undue physical effort and it may also be unsafe. There is generally nothing to prevent the telescoping sections of the apparatus from collapsing when the locking pin is removed and thereby injuring the user.

Another drawback of the prior art athletic support devices is that in order to retain their stability, they must be securely mounted to the wall, floor, or ceiling. A rigid mounting may cause damaging structural vibrations in the building when the punching bag is used extensively. This is particularly true if the wall to which the device is attached is of lightweight or hollow construction. The structural limits of this type of construction may even preclude rigid mounting. In addition, there are added installation costs associated with attaching the device rigidly to the floor or walls in the building. Rigidly mounting the athletic device to the building means that the device is no longer portable and therefore not easily moved from its installed location.

Therefore, an object of the present invention is to provide a punching bag support device which is stable during use but which remains portable and easily moveable.

Another object of the present invention is to provide a punching bag support device that is adjustable so that the height of the punching bag may be adjusted to accommodate users of differing stature.

Still another object of the present invention is to provide an adjustable punching bag support device that can be safely and easily adjusted to provide for ease of operation of the adjusting mechanism and for enhanced safety of the user.

Yet another object of the present invention is to provide an adjustable punching bag support device that is stable and remains in place when in use, but may be easily moved to another location.

SUMMARY OF THE INVENTION

The foregoing and other objects and advantages of the present invention are achieved in a punching bag support device that includes a base with a first hollow support member attached to the base and extending vertically therefrom and a second support member telescopically mounted inside the first support member. At the top end of the second support member, an upper support frame is attached to support a punching bag. In a preferred embodiment, there is a first rack gear attached to the outer surface of the second support member and a pinion gear attached to the outer surface of the first lower support member such that the rack and pinion gear are mutually engaged. Additionally, in a preferred embodiment, there is a pressure cylinder that is disposed inside the first hollow support member between the bottom of the second support member and the base. A locking device including a second rack gear that is designed to mesh with the rack gear on the second upper support means in order to hold the punching bag support at the height desired by the user is also included.

During use of the punching bag support device, in a preferred embodiment, the user releases the second locking rack gear from the first rack gear and rotates a crank attached to the pinion gear to change the height of the punching bag. The pressure or safety cylinder inside the first hollow support unit allows for quick upward adjustment of the height of the punching bag, but deliberately slows the motion of the second support member when the height of the punching bag is being adjusted downward for both increased control and safety. The locking device may be spring loaded to further increase safety so that the second rack gear is always in meshing engagement with the first rack gear on the second support member.

The foregoing and other objects, features, and advantages of the present invention will be more readily understood and apparent from the following detailed description of the invention, which should be right in conjunction with the accompanying drawing, and from the claims which are appended at the end of the detailed description.

DETAILED DESCRIPTION

Figure 1:
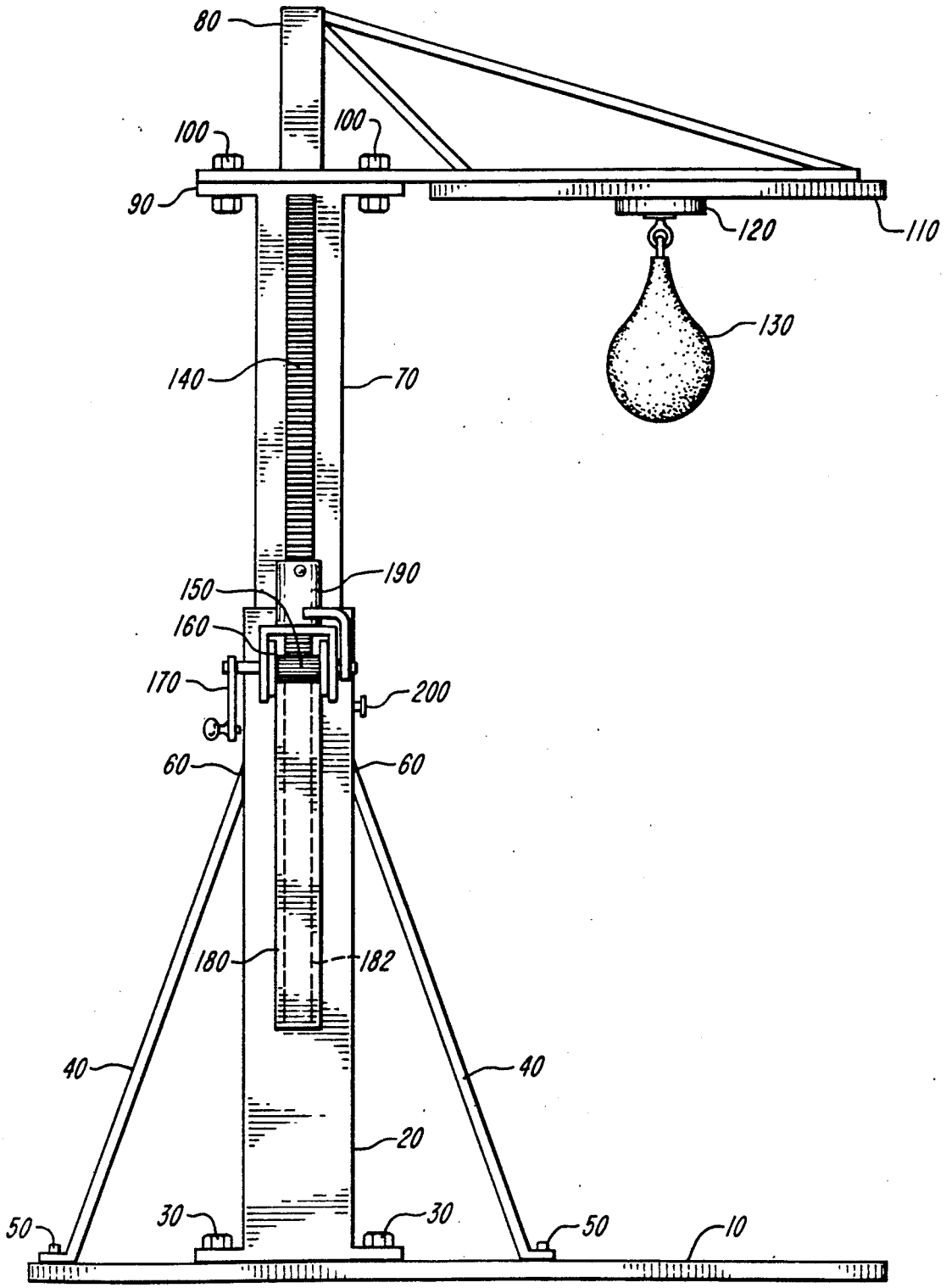
FIG. 1 is a side elevation of the punching bag support device of the present invention.

Reference is now made to FIG. 1 which is a side view of the punching bag support device of the present invention. The device includes a base 10 that is dimensioned to provide adequate structural support for the punching bag support device when it is in use. The apparatus additionally includes a hollow first support member 20 that is securely attached to the base 10 using bolts 30. Support struts 40 are attached to the base 10 using bolts 50. The other end of the support struts 40, where they contact the first hollow support member 20 at location 60, may be attached to the first support member 20 using either bolts that thread into the side wall of the lower support member 20 or they may be welded to the support member 20. The support struts 40 are spaced symmetrically around the first support member 20 in order to increase the structural integrity of the apparatus. The first support member 20 may have a round, rectangular, or square cross sectional dimension.

A second support member 70 is included in the apparatus which has a cross sectional dimension that is of the same configuration as the cross sectional dimension of the hollow portion of first support member 20. Additionally, the cross sectional dimension of the second support member 70 is sized to telescopically fit inside the hollow first support member 20. On top of the second support member 70 is an upper support member 80 attached to the flange 90 of upper support member 70 using fasteners 100 which may be threaded bolts or the like. One skilled in the art will appreciate that the second support member 70 and the upper support member 80 may be constructed as a single integrated unit. A rebound board 110 is attached to the upper support frame 80 and a punching bag support swivel mount 120 is attached to the center of the rebound board 110. Punching bag 130 is hung from swivel mount 120.

A first rack gear 140 is rigidly mounted to the side of the second support member 70. Pinion gear 150 is mounted within frame 160 and may be rotated using crank 170. One skilled in the art will appreciate that crank 170 may be embodied in other forms, such as a wheel or a ratchet handle. Rack gear housing 180 is attached longitudinally along the first support member 20. Rack gear housing 180 covers a slit (shown by dotted line 182) extending through the side wall and along the length of lower support member 20 which is sized to allow rack gear 140 to slide into a cavity defined by rack gear housing 180 as the height of the punching bag is adjusted. An additional spring loaded locking mechanism 190 is supplied which engages the rack gear 140 and holds the punching bag support device at the height selected by the user. Stabilizing pin 200 is a threaded pin that screws through a threaded opening in the outer wall of first support member 20 to engage the outer surface of the second support member 70 in order to additionally secure the punching bag at the height selected by the user. Stabilizing pin 200 additionally reduces vibrations between support members 20 and 70.

Figure 2:
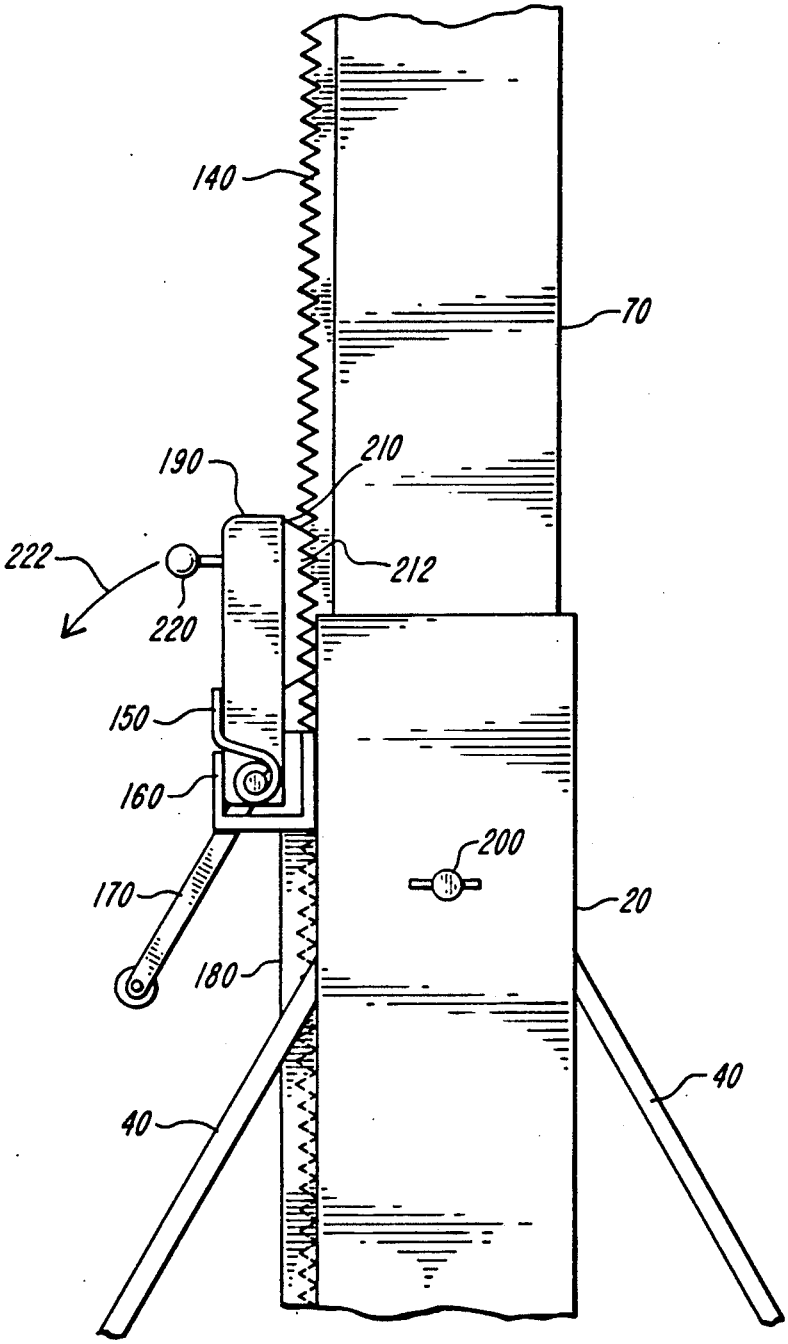
FIG. 2 is a detailed view of the apparatus of FIG. 1 showing the location of the locking device and the gear system for adjusting the height of the apparatus.

Reference is now made to FIG. 2 which shows a more detailed view of the gear mechanism used for adjusting the height of the punching bag. The locking mechanism 190 includes a second safety rack gear 210 and a handle 220. The rack gear 210 is constantly urged by the spring 150 into meshing engagement with the rack gear 140. When the user desires to change the height of the punching bag, he first loosens stabilizing pin 200. Next, the user grasps crank 170 and safety gear handle 220. The user pulls the gear away from rack gear 140 in the direction of arrow 222 and turns the crank either clockwise or counterclockwise to raise or lower the height of the punching bag. In another embodiment, the pinion gear may be rotated using a motor, such as an electric motor. After the desired height has been reached, the user releases locking mechanism 190. Spring 150 then forces the second rack gear 210 into meshing engagement with the first rack gear 140, thus securing the position chosen by the user. Finally, the user tightens stabilizing pin 200 in order to additionally secure the position of the punching bag.

In an alternate embodiment, the gear teeth 212 may be formed so as to allow the second rack gear 210 to slide with respect to the first rack gear 140 when the height of the punching bag is being raised. This makes upward adjustment quick and easy and does not require that the user pull the locking mechanism 190 away from rack gear 140. However, gear teeth 212 are additionally formed and held in meshing engagement with gear 140 by spring 150 so as to always prevent the upper support member 70 form moving downward. Thus the user can rapidly increase the height of the punching bag, but must purposely release locking mechanism 190 before the punching bag can be lowered.

Figure 3:
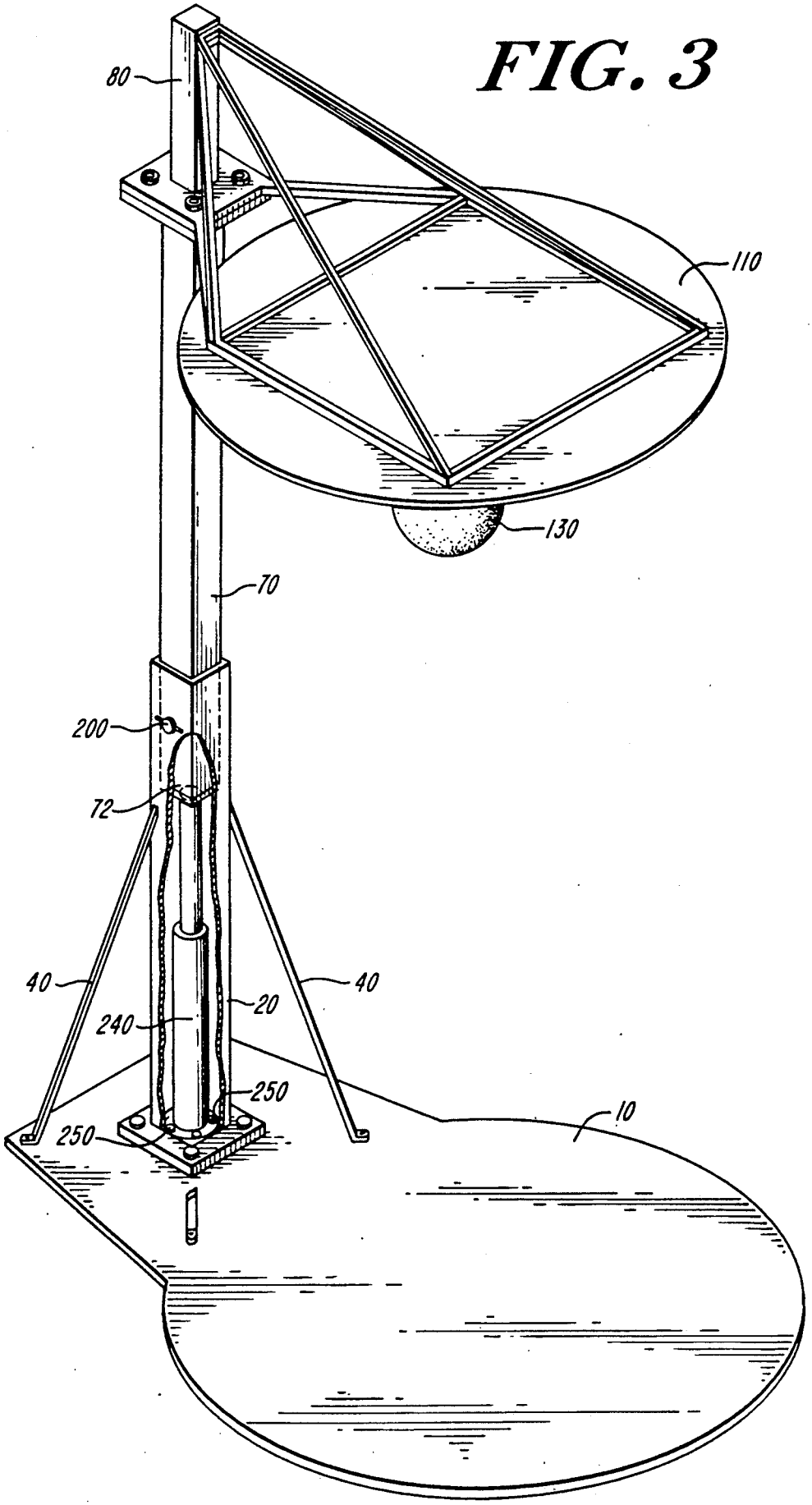
FIG. 3 is a perspective cutaway view of the apparatus of FIG. 1 showing the location of a pressure safety cylinder.

In order to increase the safety of the punching bag support device of the present invention and at the same time reduce the effort required to adjust the height of the punching bag, a pressure cylinder as shown in FIG. 3 is incorporated into the apparatus. In the illustrated embodiment, the pressure cylinder 240 is disposed inside the hollow first support member 20. However, the pressure cylinder may be located outside the first support member 20 and attached between the base 10 and the second support member 20 using brackets or the like. The pressure cylinder exerts force between the base 10 to which it is securely mounted using bolts 250 and the bottom 72 of the second support member 70. Therefore, when the user operates the rack and pinion gear mechanism (not shown in FIG. 3, but illustrated in FIGS. 1 and 2) the pressure cylinder exerts force against the second support 70 to allow for quick upward adjustment of the height of the punching bag, but deliberately slows the motion of the second support member 70 when the punching bag is being lowered for both enhanced safety and controlability.

Figure 4:
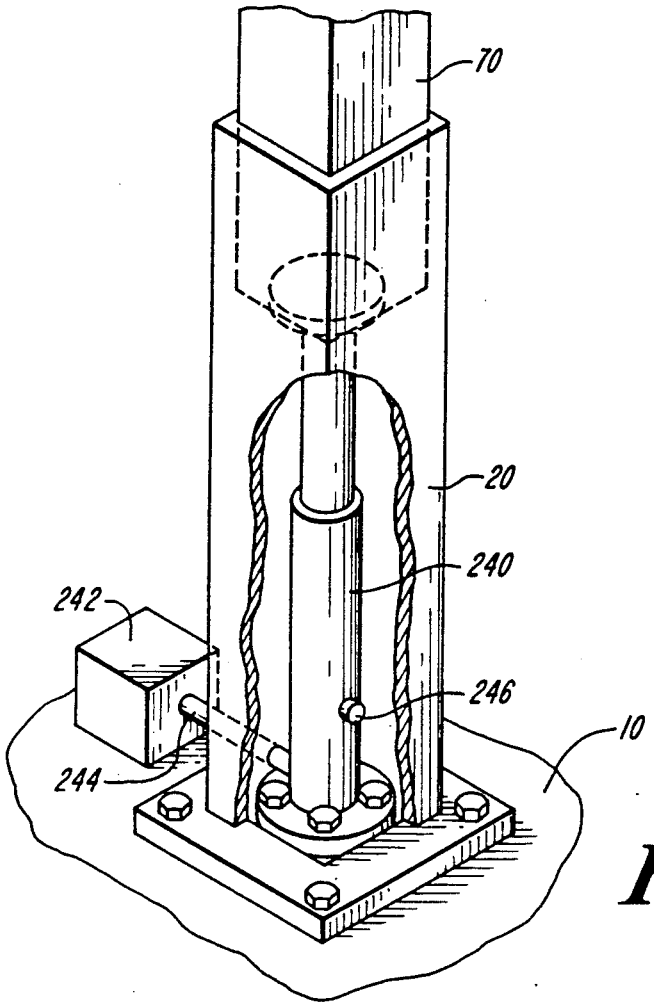
FIG. 4 is a perspective cutaway view of the apparatus of FIG. 1 showing an alternate embodiment of the pressure safety cylinder.

The pressure cylinder 240 may be embodied in several forms. The pressure cylinder may use a permanently sealed gas-charged cylinder. In another embodiment, the pressure cylinder may use a permanently sealed, liquid or oil charged cylinder. The pressure cylinder may also be of the type having a two-way valve so that when the cylinder is extended, as during upward movement of the punching bag, air is allowed to enter the pressure cylinder, but when the cylinder is compressed, as during downward movement of the punching bag, air is released through the two-way valve at a controlled rate. In another embodiment, as illustrated in FIG. 4, the pressure cylinder may also include an air pump 242 connected to the pressure cylinder via airhose 244. The air pump 242 may be an electrically operated air pump. When the user desires to increase the height of the punching bag, air pump 242 would supply pressure to reduce the effort required to raise the second support member 70. On the other hand, when the user desires to lower the height of the punching bag, bleed valve 246 releases air pressure from pressure cylinder 240 at a controlled rate, thus limiting the speed of the downward motion of second support member 70.

Figure 5:
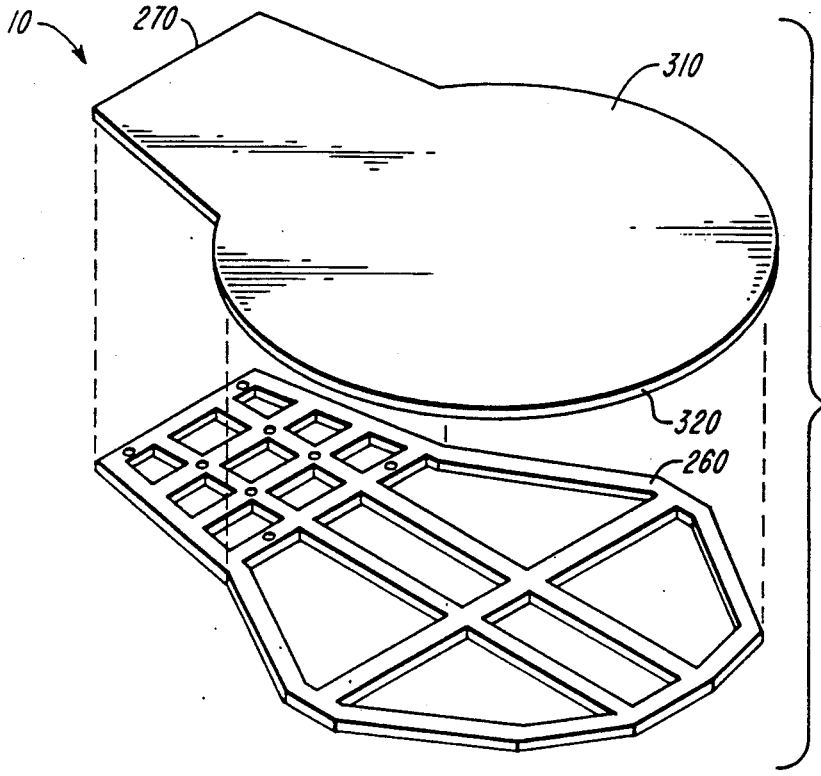
FIG. 5 is a perspective plan view showing the construction of the base for the apparatus of FIG. 1.

FIG. 5 shows additional features of base 10 of the present invention. Base 10 includes a steel bottom frame 260 and a wood platform 270 attached to the steel bottom frame. The base includes user area 320 which is sized to allow the user a wide range of motion around the punching bag without stepping off the base. The base may additionally include rubber matting or the like attached to the upper surface 310 of wood platform 270 to enhance sound absorbing capabilities and safety by providing a non-slip surface for the user. The steel bottom frame may additionally include a cushioning and friction enhancing material such as rubber applied to the bottom of the frame where the frame contacts the floor. Therefore, when a user is standing on the wood platform and using the apparatus, his additional weight in combination with a rubber matting on the bottom of the steel frame, will help prevent the apparatus from sliding on a floor surface and will additionally enhance the cushioning ability of the base 10 to reduce vibrations transmitted to the structure of the building in which the apparatus is being used.

Figure 6:
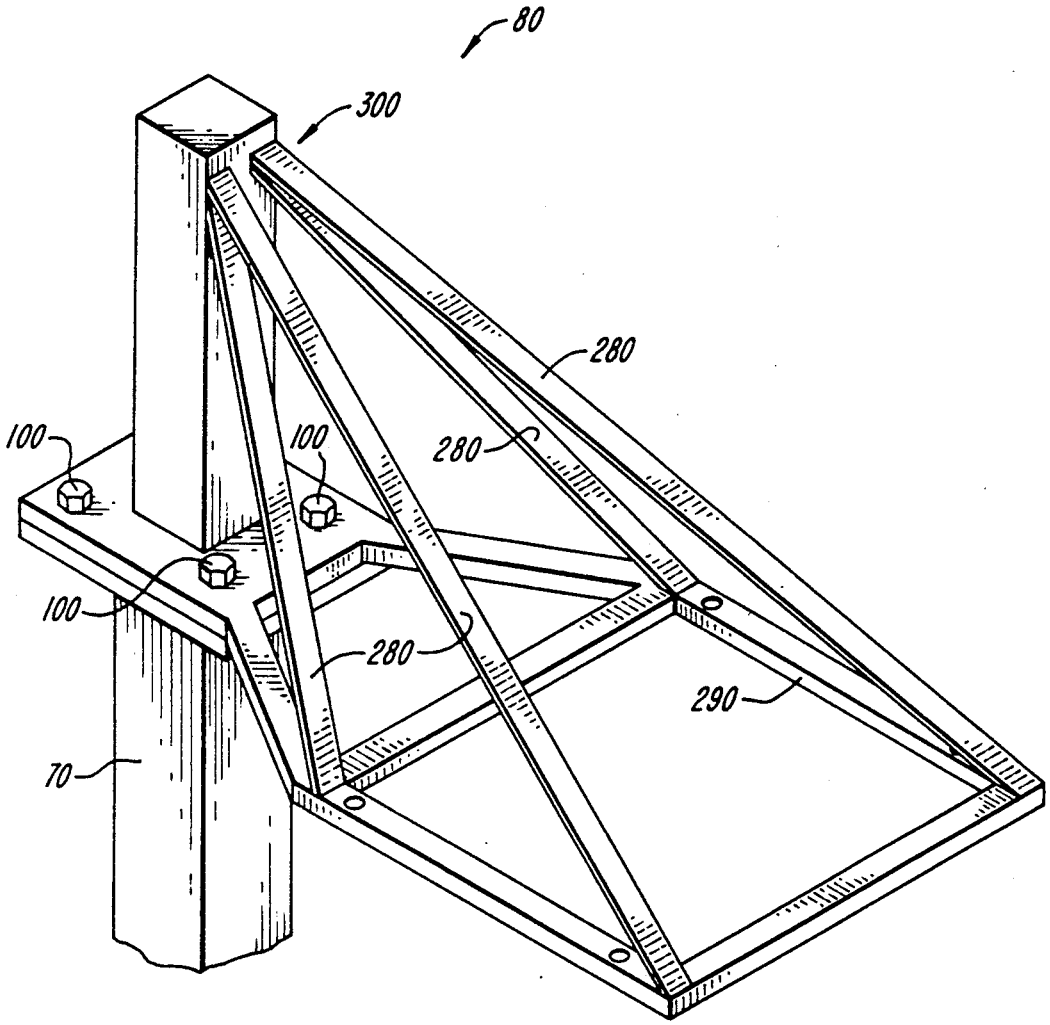
FIG. 6 is a perspective view showing the construction of the upper support frame of the apparatus of FIG. 1.

FIG. 6 shows additional details of the upper support member 80 which is used to hold the punching bag and rebound support board 110 in place. The upper support frame 80 includes support struts 280 that are welded to frame 290. Support struts 280 are also welded to the top of the upper support frame at location 300. The upper support frame 80 is bolted to the upper support member 70 using bolts 100 and is oriented to generally extend in the direction of the user area 320 of the base 10 (as shown in FIG. 1).

The punching bag support device of the present invention provides an adjustable, stable yet easily portable apparatus. Additionally, since the punching bag support device is free-standing and not rigidly mounted to the building in which it is being used, vibrations, which may be structurally damaging, are greatly reduced.

Having thus described the one particular embodiment of the invention, various alterations, modifications, and improvements will readily occur to those skilled in the art. Such alterations, modifications, and improvements as are made obvious by this disclosure are intended to be part of this disclosure though not expressly stated herein and are intended to be within spirit and scope of the invention. Accordingly, the foregoing description is by way of example only and is not intended as limiting. The invention is limited only as defined in the following claims and the equivalents thereto:

What is claimed is:

1. An apparatus for supporting a punching bag comprising:

a base means;

a first elongated support member having a hollow cross-sectional area being attached to and extending substantially perpendicularly from the base means;

a second support member having a cross-sectional dimension sized to telescopically fit inside the first support member and extending substantially in the same direction as the first support member;

an upper support means for supporting therefrom a punching bag;

a gear means for moving the second support member with respect the first support member;

a pressure cylinder disposed between the base means and the second support member;

a locking means attached to the first support member for engaging the gear means to prevent movement of the second support member;

whereby operating the gear means causes the second support member to be raised or lowered to vary the height of the upper support means and punching bag attached thereto while the pressure cylinder prevents the second support member form falling when the locking means is released.

2. The apparatus of claim 1 wherein the pressure cylinder comprises a sealed gas-charged pressure cylinder that is filled with a predetermined gas charge.

3. The apparatus of claim 1 wherein the pressure cylinder comprises a sealed pressure cylinder that is filled with a predetermined liquid charge.

4. The apparatus of claim 1 wherein the pressure cylinder includes an air pump attached to the pressure cylinder for supplying air pressure to the cylinder means and a pressure relief valve whereby air pressure is supplied to the cylinder when the second support member is to be raised and air pressure is released from the pressure cylinder through the pressure relief value when the second support member is to be lowered.

5. The apparatus of claim 1 wherein the pressure cylinder includes a two-way valve that allows air to enter the pressure cylinder when the cylinder is extended but the valve releases air from the pressure cylinder at a controlled rate when the pressure cylinder is compressed.

6. The apparatus of claim 1 wherein the gear means further comprises:

a rack gear means attached to an outer surface of the second support member, said rack gear jeans extending longitudinally along said second support member; and a pinion gear means fixedly attached to an outer surface of the first support member and disposed in meshing engagement with the rack gear means.

7. The apparatus of claim 6 further comprising a cranking means for rotating the pinion gear.

8. The apparatus of claim 7 wherein the cranking means comprises a hand operated crank.

9. The apparatus of claim 7 wherein the cranking means comprises an electric motor means.

10. The apparatus of claim 9 wherein the locking means comprises an additional rack gear means which meshed with a plurality of teeth on the rack gear means attached to the second support member.

11. The apparatus of claim 10 wherein the locking means further comprises a spring means for constantly urging the additional rack gear means into meshing engagement with the rack gear means attached to the second support member.

12. The apparatus of claim 11 wherein the additional rack gear means comprises teeth formed to slide with respect to the rack gear means only during upward adjustment of the second support member.

13. The apparatus of claim 1 further comprising a stabilizing means for securely attaching the first and second support members together.

14. The apparatus of claim 14 wherein the stabilizing means comprises a threaded pin designed to screw through a side of the first support member to engage an outer surface of the second support member.

15. The apparatus of claim 1 wherein the first and second support members are of square cross section.

16. The apparatus of claim 1 wherein the first and second support members are of round cross section.

17. The apparatus of claim 1 wherein the upper support means extends substantially perpendicular to the second support member.

18. The apparatus of claim 1 wherein the base means extends substantially in the same direction as the upper support means and includes an enlarged portion allowing the user to move around the punching bag while still remaining on the base.

19. The apparatus of claim 1 wherein the base means comprises a wood platform mounted on a steel frame.

20. The apparatus of claim 1 wherein the base means includes means for preventing slippage of the base on a surface on which the base is resting.

* * * * *